US006742678B1

(12) United States Patent
Krystopik, Jr.

(10) Patent No.: US 6,742,678 B1
(45) Date of Patent: Jun. 1, 2004

(54) POUR SPOUT ASSEMBLY

(76) Inventor: Kenneth L. Krystopik, Jr., 265 Ryan St., South Plainfield, NJ (US) 07080

( * ) Notice: Subject to any disclaimer, the term of this patent is extended or adjusted under 35 U.S.C. 154(b) by 149 days.

(21) Appl. No.: 10/076,588

(22) Filed: Feb. 15, 2002

(51) Int. Cl.[7] ..... B67D 3/00

(52) U.S. Cl. ..... 222/481.5; 222/482; 222/547; 222/566; 222/567; 222/569; 215/309

(58) Field of Search ..... 222/481.5, 482, 222/478, 479, 551, 552, 562, 566, 567, 568, 569, 570; 215/309; 220/367.1

(56) References Cited

U.S. PATENT DOCUMENTS

| | | | | | |
|---|---|---|---|---|---|
| 880,669 | A | * | 3/1908 | Keller | 222/481.5 |
| 1,913,393 | A | * | 6/1933 | Jones | 222/482 |
| 2,013,715 | A | * | 9/1935 | Lohse | 222/325 |
| 2,642,007 | A | * | 6/1953 | Renzi | 222/479 |
| 2,825,495 | A | * | 3/1958 | Fazio | 222/478 |
| 2,828,054 | A | * | 3/1958 | Chiarmonte | 222/479 |
| 3,207,375 | A | | 9/1965 | Bereziat et al. | |
| 3,208,650 | A | | 9/1965 | La Ham | |
| 3,235,133 | A | * | 2/1966 | Zimmerman et al. | 222/478 |
| 3,630,419 | A | * | 12/1971 | Pierce | 222/478 |
| 3,966,099 | A | * | 6/1976 | Sanford, Jr. et al. | 222/478 |
| 4,398,652 | A | | 8/1983 | Ueda et al. | |
| D291,780 | S | | 9/1987 | Guttormson | |
| 5,072,861 | A | * | 12/1991 | Jou | 222/481 |
| 5,092,498 | A | | 3/1992 | Willems et al. | |
| 5,397,027 | A | * | 3/1995 | Koch et al. | 222/1 |
| 5,601,217 | A | * | 2/1997 | Wagner | 222/481.5 |
| 5,799,836 | A | * | 9/1998 | Lee | 222/189.07 |
| 5,961,008 | A | * | 10/1999 | Peckels | 222/477 |
| 6,123,225 | A | * | 9/2000 | Peckels | 222/1 |
| 6,230,944 | B1 | * | 5/2001 | Castellano et al. | 222/481.5 |

* cited by examiner

*Primary Examiner*—Gene Mancene
*Assistant Examiner*—Frederick C Nicolas

(57) ABSTRACT

A pour spout assembly for providing a pour spout attachable to a bottle and including a cap securable to the pour spout between uses. The pour spout assembly includes a spout member having an attachment portion adapted for coupling to various sizes of bottle openings. The spout member further includes exterior threading on an outer perimeter of a spout portion extending from the bottle when the spout member is attached to the bottle. A cap member is provided for covering the spout portion of the spout member. The cap member has threading on an interior surface complimentary to the threading on the spout portion of the spout member to permit securing of the cap member to the spout member.

8 Claims, 3 Drawing Sheets

POUR SPOUT ASSEMBLY

BACKGROUND OF THE INVENTION

1. Field of the Invention

The present invention relates to bottle pour spouts and more particularly pertains to a new pour spout assembly for providing a pour spout attachable to a bottle and including a cap securable to the pour spout between uses.

2. Description of the Prior Art

The use of bottle pour spouts is known in the prior art. U.S. Pat. No. 4,398,652 describes a pour spout designed specifically for pouring multiple streams of beer. Another type of bottle pour spout is U.S. Pat. No. 6,123,225 having a structure to improve insertion and extraction of the pour spout and for portion control when pouring. U.S. Pat. No. 3,270,375 provides a closure assembly that incorporates a blade for cutting a tube to form a spout when the container is ready for use. U.S. Pat. No. 5,092,498 discloses a flexible tube for dispensing liquid from a bottle having an exteriorly threaded neck. U.S. Pat. No. 3,208,650 provides a spout assembly with a flip cap. U.S. Pat. No. Des. 291,780 shows an ornamental appearance for a dispensing nozzle.

While these devices fulfill their respective, particular objectives and requirements, the need remains for a pour spout that provides smooth pouring from bottles having various opening sizes and a cap securable to the pour spout to prevent excessive spillage and contamination of the contents of the bottle.

SUMMARY OF THE INVENTION

The present invention meets the needs presented above by providing a cap member securely couplable to the exterior surface of a spout portion of a spout securely connectable to various sizes of bottle openings.

Still yet another object of the present invention is to provide a new pour spout assembly that has a cap member that will remain coupled to the spout member when the bottle is tipped over.

Even still another object of the present invention is to provide a new pour spout assembly that prevents outside contaminants from entering the bottle through the pour spout while the cap member is attached to the pour spout.

To this end, the present invention generally comprises a spout member having an attachment portion adapted for coupling to various sizes of bottle openings. The spout member further includes exterior threading on an outer perimeter of a spout portion extending from the bottle when the spout member is attached to the bottle. A cap member is provided for covering the spout portion of the spout member. The cap member has threading on an interior surface complimentary to the threading on the spout portion of the spout member to permit securing of the cap member to the spout member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
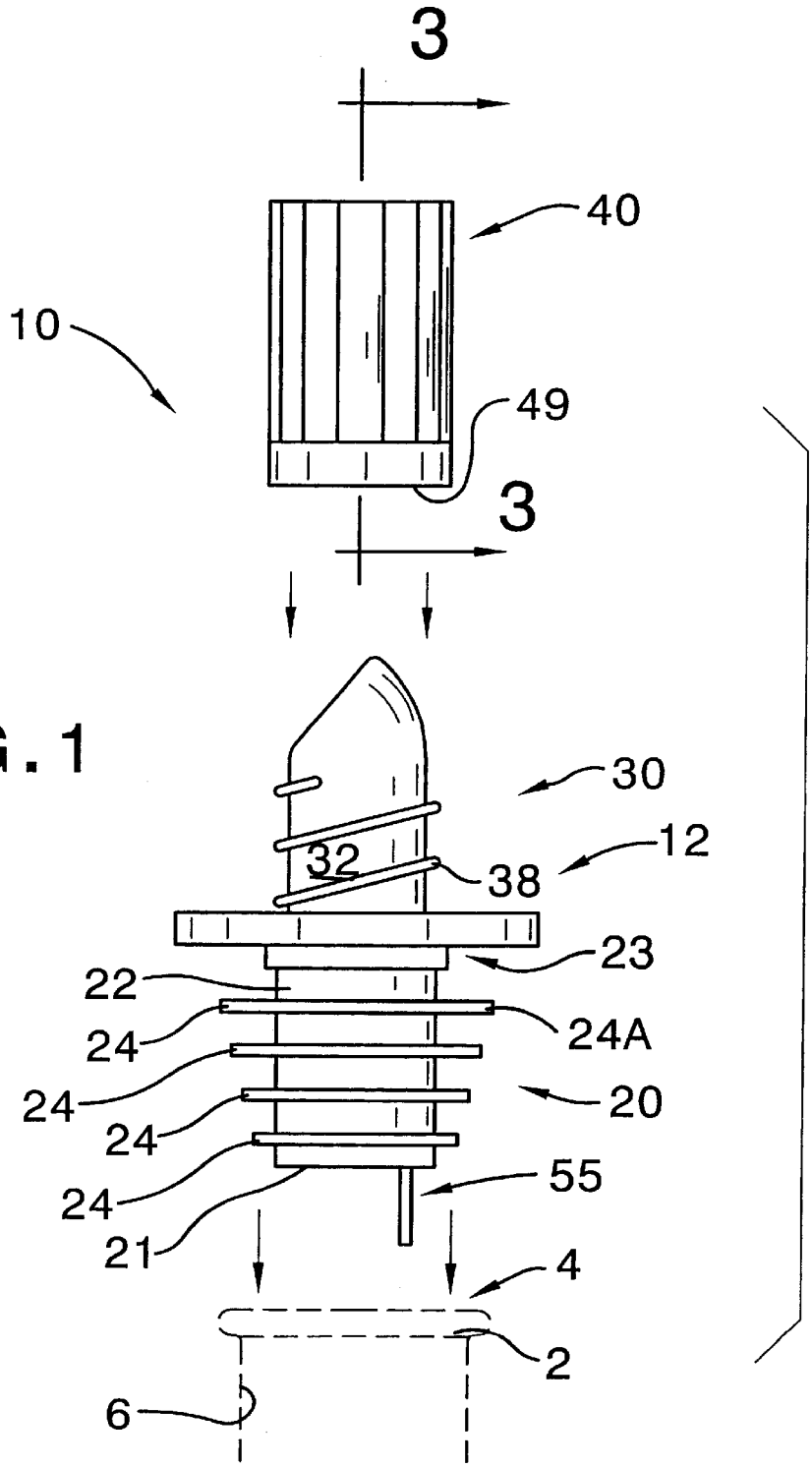
FIG. 1 is an exploded side view of a new pour spout assembly according to the present invention.
Figure 2:
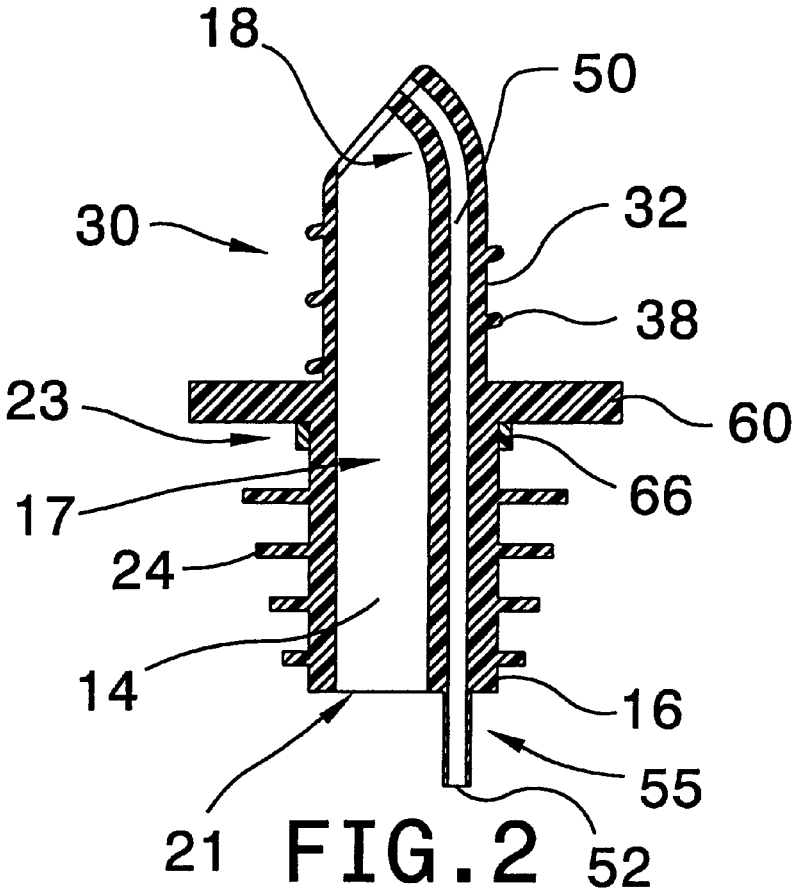
FIG. 2 is a cross-sectional view of the spout member of the present invention.
Figure 3:
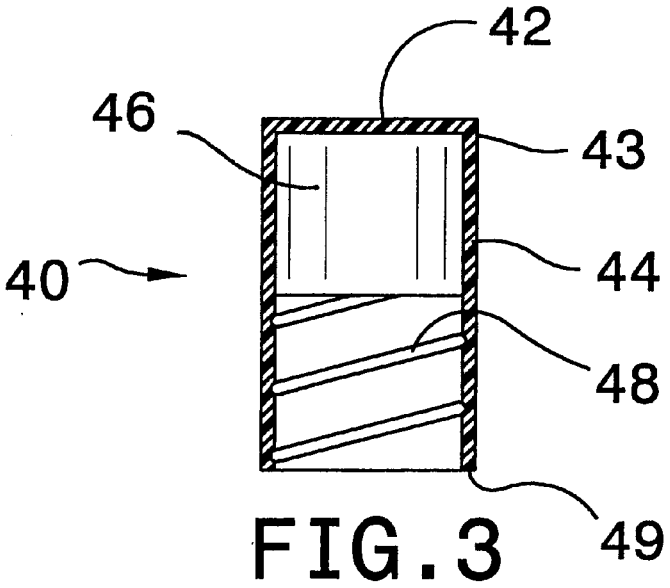
FIG. 3 is a cross-sectional view of the cap member of the present invention.
Figure 4:
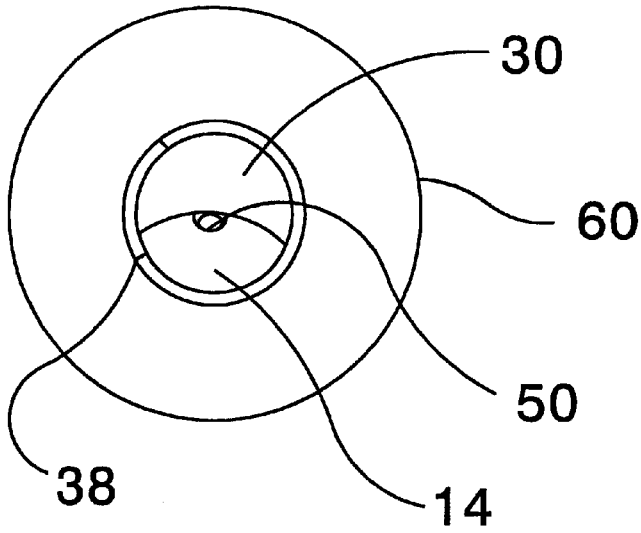
FIG. 4 is a top view of the spout member of the present invention.
Figure 5:
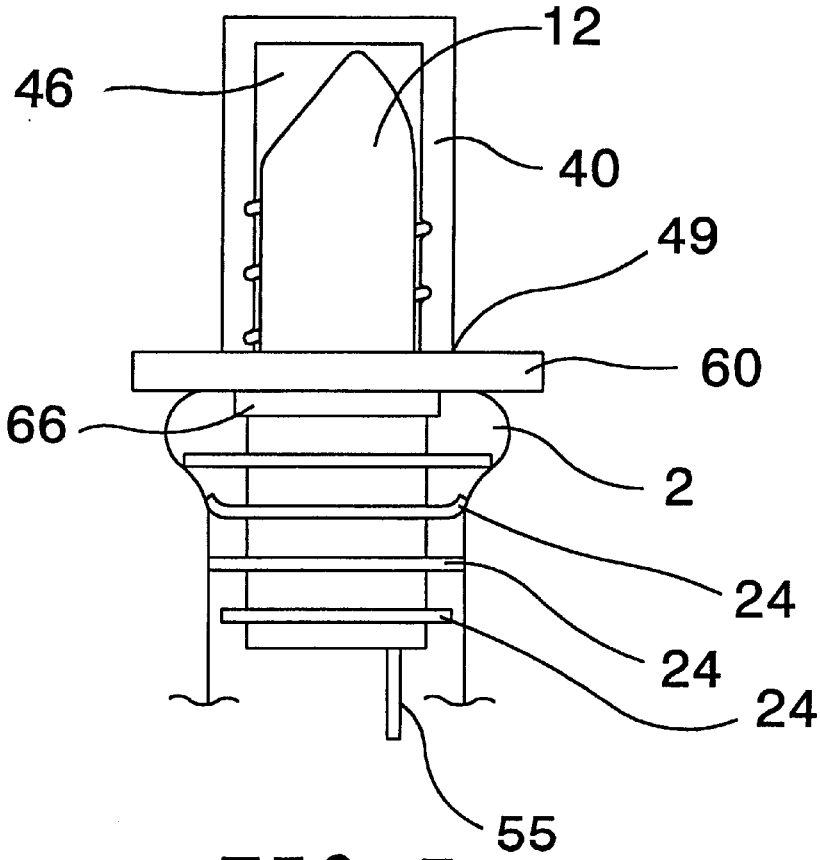
FIG. 5 is a side view of the present invention.

With reference now to the drawings, and in particular to FIGS. 1 through 5 thereof, a new pour spout assembly embodying the principles and concepts of the present invention and generally designated by the reference numeral 10 will be described.

As best illustrated in FIGS. 1 through 5, the pour spout assembly 10 generally comprises a pour spout member 12 that has a connection portion 20 designed for insertion into an opening 4 of a bottle 2. Thus, the pour spout member 12 is coupled to the bottle 2. The pour spout member 12 further has a spout portion 30 that extends from the connection portion 20 and a conduit 14 that passes through the pour spout member 12 such that the pour spout member 12 is designed for permitting pouring of contents of the bottle 2 through the pour spout member 12.

A cap member 40 has a closed top 42 and a perimeter wall 44 that extends from a perimeter edge 43 of the closed top 42. An interior surface 46 of the perimeter wall 44 has threading 48.

An exterior surface 32 of the spout portion 30 has threading 38. The pour spout threading 38 is complimentary to the threading 48 of the cap member 40. Thus, the cap member 40 is securable to the spout portion 30 of the pour spout member 12.

The pour spout member 12 includes a venting duct 50 that extends through the pour spout member 12. The venting duct 50 is positioned to extend along an outer edge 16 of the pour spout member 12 to permit tilting of the pour spout member 12 such that an end 52 of the venting duct 50 is positioned above a surface of contents of the bottle 2 when tilted to pour contents of the bottle 2 through the conduit 14.

The connection portion 20 of the pour spout member 12 includes an interior wall 22 and a plurality of annular flanges 24 that extend outwardly from the interior wall 22 such that the annular flanges 24 are designed for frictionally engaging an interior surface 6 of the bottle 2 when the connection portion 20 is inserted into the bottle 2. Thus, the connection portion 20 is coupled to the bottle 2.

An annular lip member 60 extends outwardly from the pour spout member 12 between the connection portion 20 and the spout portion 30. A bottom 49 of the perimeter wall 44 of the cap member 40 abuts the annular lip 60 when the cap member 40 is fully secured to the pour spout member 12 for preventing leakage between the pour spout member 12 and the cap member 40.

Each of the annular flanges 24 has a unique diameter with respect to each other annular flange 24. The annular flanges 24 are arranged in spaced relationship to each other by increasing diameter moving from a distal end 21 of the connection portion 20 to a proximal end 23 of the connection portion 20.

The annular lip member 60 has a diameter greater than an adjacently positioned one of the annular flanges 24A for facilitating grasping of the annular lip 60 when removing and inserting the pour spout member 12.

The venting duct 50 has a distal portion 55 that extends downwardly from the distal end 21 of the connection portion 20.

An upper portion 18 of the conduit 14 is curved for directing contents of the bottle 2 outwardly from the pour spout member 12 at an acute angle relative to a longitudinal axis of a substantially straight portion 17 of the conduit 14.

A reinforcing ring 66 is coupled to the connection portion 20 and is positioned adjacent to the annular lip 60 for supporting the annular lip 60.

In a preferred embodiment, the annular lip has an outer diameter of 1.2 inches and a thickness of 0.1 inches. The spout portion has a length of 1.05 inches and an outer diameter of 0.55 inches. The connection portion has four annular flanges spaced 0.16 inches apart from each other. The annular flanges each have a thickness of 0.03 inches and outer diameters of 0.95 inches, 0.90 inches, 0.85 inches, and 0.75 inches. The connection portion has an outer diameter of 0.55 inches. The reinforcing ring has a thickness of 0.15 inches and an outer diameter of 0.65 inches. The distal end of the venting duct has an outer diameter of 0.23 inches and extends from the distal end of the connection portion a length of 0.60 inches.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pour spout assembly comprising:

a pour spout member having a connection portion adapted for insertion into an opening of a bottle whereby said pour spout member is coupled to the bottle, said pour spout member further having a spout portion extending from the connection portion and a conduit passing through said pour spout member such that said pour spout member is adapted for permitting pouring of contents of the bottle through said pour spout member;

a cap member, said cap member having a closed top and a perimeter wall extending from a perimeter edge of said closed top, an interior surface of said closed top being threaded;

an exterior surface of said spout portion being threaded, said pour spout threads being complimentary to said threading of said cap member whereby said cap member is securable to said spout portion of said pour spout member;

an annular lip member extending outwardly from said pour spout member between said connection portion and said spout portion, a bottom of said perimeter wall of said cap member abutting said annular lip when said cap member is fully secured to said pour spout member for preventing leakage between said pour spout member and said cap member; and a reinforcing ring coupled to said connection portion and positioned adjacent to said annular lip for supporting said annular lip.

2. The pour spout assembly of claim 1, further comprising:

said pour spout member including a venting duct extending through said pour spout member, said venting duct being positioned proximate an outer edge of said pour spout member to permit tilting of the pour spout member such that an end of said venting duct is positioned above a surface of contents of the bottle when tilted to pour contents of the bottle through said conduit.

3. The pour spout assembly of claim 1, further comprising:

said connection portion of said pour spout member including an interior wall and a plurality of annular flanges extending outwardly from said interior wall such that said annular flanges are adapted for frictionally engaging an interior surface of the bottle when the connection portion is inserted into the bottle whereby said connection portion is coupled to the bottle.

4. The pour spout assembly of claim 3, further comprising:

each of said annular flanges having a unique diameter with respect to each other annular flange, said annular flanges being arranged in spaced relationship to each other by increasing diameter moving from a distal end of said connection portion to a proximal end of said connection portion.

5. The pour spout assembly of claim 4, further comprising:

an annular lip member extending outwardly from said pour spout member between said connection portion and said spout portion, a bottom of said perimeter wall of said cap member abutting said annular lip when said cap member is fully secured to said pour spout member for preventing leakage between said pour spout member and said cap member; and said annular lip member having a diameter greater than an adjacently positioned one of said annular flanges for facilitating grasping of said annular lip when removing and inserting said pour spout member.

6. The pour spout assembly of claim 2, further comprising:

said venting duct having a distal portion extending downwardly from a bottom of said connection portion.

7. The pour spout assembly of claim 1, further comprising:

an upper portion of said conduit being curved for directing contents of the bottle outwardly from said pour spout member at an acute angle relative to a longitudinal axis of a substantially straight portion of said conduit.

8. A pour spout assembly comprising:

a pour spout member having a connection portion adapted for insertion into an opening of a bottle whereby said pour spout member is coupled to the bottle, said pour spout member further having a spout portion extending from the connection portion and a conduit passing through said pour spout member such that said pour spout member is adapted for permitting pouring of contents of the bottle through said pour spout member;

a cap member, said cap member having a closed top and a perimeter wall extending from a perimeter edge of said closed top, an interior surface of said closed top being threaded;

an exterior surface of said spout portion being threaded, said pour spout threads being complimentary to said threading of said cap member whereby said cap member is securable to said spout portion of said pour spout member;

said pour spout member including a venting duct extending through said pour spout member, said venting duct being positioned proximate an outer edge of said pour spout member to permit tilting of the pour spout member such that an end of said venting duct is positioned above a surface of contents of the bottle when tilted to pour contents of the bottle through said conduit;

said connection portion of said pour spout member including an interior wall and a plurality of annular flanges extending outwardly from said interior wall such that said annular flanges are adapted for frictionally engaging an interior surface of the bottle when the connection portion is inserted into the bottle whereby said connection portion is coupled to the bottle;

an annular lip member extending outwardly from said pour spout member between said connection portion and said spout portion, a bottom of said perimeter wall of said cap member abutting said annular lip when said cap member is fully secured to said pour spout member for preventing leakage between said pour spout member and said cap member;

each of said annular flanges having a unique diameter with respect to each other annular flange, said annular flanges being arranged in spaced relationship to each other by increasing diameter moving from a distal end of said connection portion to a proximal end of said connection portion;

said annular lip member having a diameter greater than an adjacently positioned one of said annular flanges for facilitating grasping of said annular lip when removing and inserting said pour spout member;

said venting duct having a distal portion extending downwardly from a bottom of said connection portion;

an upper portion of said conduit being curved for directing contents of the bottle outwardly from said pour spout member at an acute angle relative to a longitudinal axis of a substantially straight portion of said conduit; and a reinforcing ring coupled to said connection portion and positioned adjacent to said annular lip for supporting said annular lip.

* * * * *